US006344067B1

(12) United States Patent
Craig et al.

(10) Patent No.: US 6,344,067 B1
(45) Date of Patent: Feb. 5, 2002

(54) REFINING

(75) Inventors: Deborah Carol Craig, Lakefield (ZA); Richard Alasdhair Grant, Reading (GB)

(73) Assignee: Anglo American Platinum Corporation, Limited, Johannesburg (ZA)

( * ) Notice: Subject to any disclaimer, the term of this patent is extended or adjusted under 35 U.S.C. 154(b) by 0 days.

(21) Appl. No.: 09/627,053

(22) Filed: Jul. 27, 2000

(51) Int. Cl.[7] ..... C22B 11/00
(52) U.S. Cl. ..... 75/631; 423/22
(58) Field of Search ..... 75/631; 423/22

(56) References Cited

U.S. PATENT DOCUMENTS 4,086,084 A 4/1978 Oliver et al.
4,145,187 A * 3/1979 Oliver et al. ..... 521/117
4,770,700 A * 9/1988 Bertha et al. ..... 75/714
5,102,632 A 4/1992 Allen et al.
5,104,445 A 4/1992 Dubrovsky et al.

FOREIGN PATENT DOCUMENTS

| | | |
|---|---|---|
| CA | 2181369 | 6/1996 |
| CA | 2193783 | 6/1998 |
| GB | 1 242 938 | 8/1971 |
| GB | 1 304 084 | 1/1973 |
| GB | 1 502 765 | 3/1978 |
| SU | 945214 | 7/1982 |
| WO | 96/17097 | 6/1996 |

* cited by examiner

*Primary Examiner*—Roy King
*Assistant Examiner*—Tima McGuthry-Banks
(74) *Attorney, Agent, or Firm*—Ratner & Prestia

(57) ABSTRACT

Precious metal-containing concentrates are subjected to high temperature chlorination using HCl gas, an optional reduction, an oxidation and finally a reduction, to remove most of the base metals especially the amphoteric elements.

16 Claims, No Drawings

REFINING

The present invention concerns improvements in refining, more especially it concerns an improved process useful in the refining of precious metals.

In this specification, we intend "precious metal" to include one or more of gold and the platinum group metals ("PGMs", namely Pt, Rh, Pd, Ru, Ir, Os). Silver is not to be regarded as precious metal.

After the mining of precious metal ores, or as a by-product of mining other minerals, for example, nickel, or in the recovery of precious metal values from recycled materials, it is common to produce a concentrate containing precious metal components, silver compounds and base metal compounds (which means compounds of any other metal or amphoteric). The number and quantities of individual base metal compounds may vary substantially according to the origin of the concentrate. Preferred concentrates for use in the present invention are mine concentrates containing about 60 wt % or more of precious metal, but other concentrates may be used instead. It is envisaged, therefore, that suitable feedstocks for the present invention are concentrates containing more than 50 wt %, preferably about 60 wt %, of precious metal, in admixture with base metals, including particularly arnphoteric elements. It has been found that certain elements such as copper, nickel, iron, cobalt, sulphur, silver, selenium, lead, tellurium, zinc, bismuth, arsenic, antimony and tin, are generally deleterious and disadvantageous in refining the precious metals and even some of the precious metals have such low value and create complications in further refining that it would be helpful to separate at least a proportion thereof; osmium is such a precious metal.

A number of processes involving chlorination of precious metal feedstocks have previously been disclosed. For example, GB 1,502,765 (Matthey Rustenberg Refiners) discloses a process by which a solid concentrate is treated with a halogen-containing gas to remove base metals and silver by volatilisation of the corresponding halides. A preferred subsequent step is to dissolve the precious metal-containing residue in hydrochloric acid containing an oxidising agent. Another proposed process is disclosed in CA 2,181,369 (Prior Engineering), and this comprises three steps of oxidising feedstock at a first temperature, reducing the residue at a second temperature and chlorinating in a third step. The first oxidising step is a roasting step using oxygen or an oxygen-containing gas, and removes sulphur and amphoterics such as selenium as their dioxides, and it is possible that some osmium is volatilised as its tetroxide. A proportion of the metals remaining are oxidised, and therefore a reduction step follows, using a reducing gas such as hydrogen or a hydrogen-containing gas. The final step of chlorination preferably uses chlorine, and converts the majority of the base metals present to chlorides, which are generally volatile at the temperatures employed. (800 to 1300° C.), and are removed in the gas stream. Whilst this can certainly be regarded as beneficial, we have carried out tests which indicate that a number of volatile precious metal chlorides are also formed, causing significant losses of gold, palladium and ruthenium. This chloride formation, therefore, must remove this process from serious consideration in refining such precious metal concentrates. There remains, therefore, a need for a practicable refining process which converts a precious metal concentrate to a refined product amenable to further processing and with minimal losses of the valuable precious metals.

The present invention provides a method for the refining of a solid precious metal-containing concentrate comprising the following steps:

1. a high temperature treatment of the concentrate with hydrogen chloride gas to yield a first residue;
2. an optional treatment of the first residue with chlorine gas to yield a second residue.
3. a high temperature treatment of the first or second residue with oxygen to yield a third residue, and
4. a high temperature treatment of the third residue with hydrogen to yield a final residue.

It is to be understood that the HCl gas, $Cl_2$, $O_2$ and $H_2$ gas may be in admixture with an inert gas or any other gas that does not interfere with the primary reactions taking place. The gas may possibly be substituted by a precursor(s) for the gas, if appropriate for example, hydrogen and chlorine react to form HCl. It is preferred to flush each residue with an inert or other non-interfering gas between each process step, if there is any risk of forming an explosive mixture. Our experimental work has found that a flush with nitrogen for 15 minutes is sufficient for this purpose.

We have found that the steps 1,3, and 4 of the method of the invention can be carried out at the same high temperature, suitably in the range 750° C. to 1100° C., preferably 850° C. to 1050° C., especially about 950° C. The chlorination step 2, however, is preferably carried out at a lower temperature, e.g. 200 to 400° C., preferably about 300° C. Details of preferred operating temperatures are given below.

Initial tests have shown that, operating under the preferred conditions, total losses of Pt, Pd, Rh and Ir are less than 1% while achieving >98% removal of Se, >80% removal of Te and >98% removal of As. There are losses of Os of the order of 50–60% but this is not regarded as a serious penalty, and losses of Ru of from 2 to 4% but the majority of this can be recovered using known procedures which form no part of the present invention.

The feedstock may be any solid concentrate from mining the platinum group metals, or a concentrate from refining processes applied to primary (that is, from mine production) or secondary (that is, from recycled precious metals) or mixtures thereof. The method of the invention is believed to be sufficiently robust to cater for a wide variety of feedstocks. These may be comminuted or in agglomerated (e.g. briquette or pellets or similar) form. We have found that there can be a physical loss of precious metal fines in the gas stream if conventional processes such as fluidised beds or upward gas flow are used. Accordingly, it is preferred to operate each of the steps in a downflow gas mode in a reactor vessel such as a vertical tube. A gas-permeable base is preferably used in the reactor vessel. The gases removed from each step may be treated in conventional scrubbers and metal values collected by essentially conventional processing. It is preferred to avoid condensation of volatile products prior to the scrubbers, and heating of pipework and tubes may be necessary to avoid build-up of condensates and possible blockages.

In a first embodiment, the method is directed to minimising the losses of desired precious metals, whilst removing as much deleterious material as possible. In a second embodiment which includes the optional chlorination step, the method is directed to removing as much of the deleterious elements as possible, with less emphasis on precious metal losses. The embodiment chosen will depend largely on individual feedstocks and the downstream refining and metal separation technology that is available. In brief, one example of carrying out the first embodiment is as follows:

During the first step of the method, the solid feedstock is subject to a chlorinating environment in the form of hydrogen chloride gas. The temperature range should be maintained between 750° C. and 1100° C., preferably 850° C.–1050° C., especially about 950° C. This environment is conducive to removing the majority of the base metal elements by forming stable base metal chlorides that are volatilised. To a lesser degree, the amphoteric elements are also removed.

Prior to the oxidative treatment, the furnace is flushed with an inert gas, usually nitrogen. In the presence of oxygen, the problematic amphoteric elements such as selenium, tellurium and arsenic are removed as their metal oxides.

The temperature range for this operation should be within 750° C. and 1100° C., preferably 850° C. to 1050° C., especially about 950° C.

Once again the furnace gas must be flushed with an inert gas before the environment is switched from the oxidative to the reductive by the introduction of hydrogen. The most important reason for including this step is to reduce the precious metal components to their lowest oxidation state (their metals) which will render them most soluble in the conventional refining operation of an acid and oxidising medium for precious metal dissolution. The reduction is more effective if the temperature is not less than 750° C., but lower temperatures and longer treatment times are also effective. Certain materials, for example rhodium oxide, may be reduced at lower temperatures, for example of the order of 200° C. to 300° C. If alternative dissolution or processing steps are carried out, this sequence may no longer be required.

At the end of the method, the remaining solid material in the reaction vessel will contain the majority of the platinum, palladium, gold, rhodium iridium, ruthenium, silica and a portion of the osmium. A very small amount of base metal and amphoteric elements that were originally present in the starting material will be present.

In brief, the second embodiment may be carried out as follows:

During the first step of treatment, the material is subject to a chlorination environment in the form of hydrogen chloride gas. The temperature range must be maintained between 750° C. and 1100° C., preferably 850° C.–1050° C., especially about 950° C. The objective of this environment is as described above.

Prior to the reductive treatment, the furnace is flushed with an inert gas, usually nitrogen. If desired, an optional reduction in the presence of hydrogen may be included, in which the amphoteric elements are reduced to their lowest oxidation states, this prepares them for easier volatilisation during the next treatment stage. The temperature range for this operation should be within 750° C. and 1100° C., preferably 850° C.–1050° C., especially about 950° C.

Prior to the chlorination treatment, the furnace is flushed and cooled with an inert gas, usually nitrogen. In the presence of chlorine, the amphoteric elements like selenium, tellurium and arsenic are largely removed as their chloride forms. The temperature range for this operation should be within 250° C. and 500° C., preferably 300° C.–350° C.

Prior to the oxidative treatment, the furnace is flushed with an inert gas, usually nitrogen and the temperature is increased during this operation. In the presence of oxygen, the remaining amphoteric elements and osmium are volatilised in their oxide forms. The temperature range for this operation should be within 750° C. and 1100° C., preferably 850° C.–1050° C., especially about 950° C.

Once again the furnace gas must be flushed with an inert gas before the environment is switched from the oxidative to the reductive by the introduction of hydrogen. The reason for including this step is discussed above.

At the end of the thermal treatment, the remaining solid material in the reaction vessel will contain the majority of the platinum, palladium, gold, rhodium, iridium, ruthenium, silica and a portion of the osmium. A very small amount of the original base metal and amphoteric elements will be present in the product.

Treatment times and stoichiometric excess of gas may be varied according to the starting materials and the quantities of the various impurities therein.

There has been an observed trend whereby, the higher the flow rate of gas, the lower the time required for exposure to process the material. However, if the flow rate is too high, and there is an upward gas flow, there is significant physical loss of unreacted material with the gas to the volatile collection vessel due to entrainment.

The invention will now be described by way of examples of each embodiment.

EXAMPLE 1

FIRST EMBODIMENT

The procedure followed is described below, after charging a mine concentrate into the reactor vessel:

Heat reactor vessel mounted inside furnace to 950° C. under nitrogen gas

Switch gas to hydrogen chloride at 950° C. for 3 hours 30 minutes

Flush with nitrogen gas for 15 minutes

Switch gas to oxygen at 950° C. for 1 hour

Flush with nitrogen gas for 15 minutes

Switch gas to hydrogen at 950° C. for 1 hour

Flush and cool furnace to room temperature under nitrogen gas

Analysis of the residue after the final step gave the following results:

Pt<0.25% Loss

Pd<0.3% Loss

Au<0.9% Loss

Rh<0.35% Loss

Ir<0.2% Loss

Ru<2.0% Loss

Os~60% Loss

Se>98% Removal

Te>80% Removal

As>98% Removal

Total PGM loss ~0.3% excl. Os, Ru

EXAMPLE 2

SECOND EMBODIMENT

Using the same equipment and the same mine concentrate feedstock:

Heat furnace to 950° C. under nitrogen gas

Switch gas to hydrogen chloride at 950° C. for 1 hour 40 minutes

Flush with nitrogen gas for 15 minutes } This is an optional

Switch gas to hydrogen at 950° C. for 30 minutes } step.

Flush with nitrogen gas and cool furnace to 300° C.

Switch gas to chlorine at 300° C. for 30 minutes

Flush with nitrogen gas and heat furnace to 950° C.

Switch gas to oxygen at 950° C. for 30 minutes

Flush with nitrogen gas for 15 minutes

Switch gas to hydrogen at 950° C. for 1 hour

Flush and cool furnace to room temperature under nitrogen gas.

Analysis of the residue after the final step gave the following results:

Pt<0.16% Loss

Pd<2.16% Loss

Au<2.0% Loss

Rh<0.09% Loss

Ir<0.3% Loss

Ru<4.06% Loss

Os~54% Loss

Se>99% Removal

Te>96.5% Removal

As>99% Removal

Total PGM loss ~0.81% excl. Os, Ru.

EXAMPLE 3

COMPARATIVE

The description of the process in CA 2,181,369 was followed, but using "best guess" conditions in the absence of working examples, and using the same equipment as above:

Heat furnace to 450° C. under nitrogen gas

Switch gas to oxygen at 450° C. for 1 hour

Flush with nitrogen gas and heat furnace to 700° C.

Switch gas to hydrogen at 700° C. for 1 hour

Flush with nitrogen gas and heat furnace to 1000° C.

Switch gas to chlorine at 1000° C. for 1 hour and 40 minutes

Flush and cool furnace to room temperature under nitrogen gas

Analysis of the product yielded the following results:

Pt<0.36% Loss

Pd~3.77% Loss

Au~16.64% Loss

Rh<2.52% Loss

Ir<0.81% Loss

Ru~63.64% Loss

Os~84.61% Loss

Se>99% Removal

Te>98% Removal

As>99% Removal

Total PGM loss~7.38% excl. Os and~2% excl. Os and Ru

EXAMPLE 4

COMPARATIVE

The process in GB 1,502,765 was followed, using the same equipment and feedstock as above:

Heat furnace to 1000° C. under nitrogen gas

Switch gas to hydrogen chloride at 1000° C. for 1 hour and 40 minutes

Flush and cool furnace to room temperature under nitrogen gas

Analysis of the product yielded the following results:

Pt<0.05% Loss

Pd<0.03% Loss

Au<0.11% Loss

Rh<0.04% Loss

Ir<0.05% Loss

Ru<0.03% Loss

Os<2.83% Loss

Se<0.6% Removal

Te<3% Removal

As~47.52% Removal

Total PGM loss<0.04% excl. Os

It can be readily seen from reviewing the analytical results that the Examples of the invention yield good PGM recoveries whilst at the same time achieving excellent reductions in the problematic contaminants Se, Te and As.

The invention may be carried out in a variety of ways and with differences in detail conditions compared to the above description, without departing from the scope hereof.

We claim:

1. A method for refining a solid precious metal-containing concentrate comprising the steps of:

A. treating the concentrate at a first temperature with hydrogen chloride gas to yield a first residue;

B. treating the first residue with chlorine gas to yield a second residue;

C. treating the second residue at a second temperature with oxygen to yield a third residue; and D. treating the third residue with hydrogen at a third temperature to yield a final residue.

2. A method as claimed in claim 1, further comprising, prior to step B, treating the first residue with hydrogen gas.

3. A method as claimed in claim 2, wherein the step of treating the first residue with hydrogen gas is carried out at a temperature in the range of 750° to 1100° C.

4. A method as claimed in claim 1, wherein the first, second and third temperatures are in the range of 750° to 1100° C.

5. A method as claimed in claim 4, wherein the first, second and third temperatures are in the range of 850° to 1050° C.

6. A method as claimed in claim 5, wherein the first, second and third temperatures are approximately 950° C.

7. A method as claimed in claim 1, wherein step B is carried out at a temperature of from 250° to 500° C.

8. A method as claimed in claim 7, wherein step B is carried out at a temperature of from 300° to 350° C.

9. A method as claimed in claim 1, wherein steps A–D are carried out in a reactor using downward gas flows.

10. A method for refining a solid precious metal-containing concentrate comprising the steps of:

A. treating the concentrate at a first temperature with hydrogen chloride gas to yield a first residue;

B. treating the first residue with oxygen at a second temperature to yield a second residue; and C. treating the second residue with hydrogen at a third temperature to yield a final residue.

11. A method as claimed in claim 10, further comprising, prior to step B, treating the first residue with hydrogen gas.

12. A method as claimed in claim 11, wherein the step of treating the first residue with hydrogen gas is carried out at a temperature in the range of 750° to 1100° C.

13. A method as claimed in claim 10, wherein the first, second and third temperatures are in the range of 750° to 1100° C.

14. A method as claimed in claim 13, wherein the first, second and third temperatures are in the range 850° to 1050° C.

15. A method as claimed in claim 14, wherein the first, second and third temperatures are approximately 950° C.

16. A method as claimed in claim 10, wherein steps A–C are carried out in a reactor using downward gas flows.

* * * * *

UNITED STATES PATENT AND TRADEMARK OFFICE

CERTIFICATE OF CORRECTION

PATENT NO. : 6,344,067 B1
DATED : February 5, 2002
INVENTOR(S) : Deborah Carol Craig et al.

It is certified that error appears in the above-identified patent and that said Letters Patent is hereby corrected as shown below:

Title page,
Please insert the following:
-- [30] Foreign Application Priority Data
27 July 1999 (GB)..... 9917564.8 --

Signed and Sealed this

Twelfth Day of November, 2002

*Attest:*

*Attesting Officer*

JAMES E. ROGAN
*Director of the United States Patent and Trademark Office*